US005673635A

United States Patent [19]

Fowler

[11] Patent Number: 5,673,635

[45] **Date of Patent: *Oct. 7, 1997**

[54] PROCESS FOR THE RECYCLING OF ORGANIC WASTES

[75] Inventor: Benjamin P. Fowler, Houston, Tex.

[73] Assignee: L.E. Maxwitat, Friendswood, Tex.

[ * ] Notice: The term of this patent shall not extend beyond the expiration date of Pat. No. 4,934,286 and 5,022,848.

[21] Appl. No.: 491,304

[22] Filed: Jun. 12, 1995

[51] Int. Cl.[6] ..... F23J 11/00

[52] U.S. Cl. ..... 110/345; 110/229

[58] Field of Search ..... 110/345, 229, 110/224

[56] References Cited

U.S. PATENT DOCUMENTS

| | | | |
|---|---|---|---|
| 4,934,286 | 6/1990 | Fowler | 110/346 |
| 5,022,848 | 6/1991 | Fowler | 431/3 |
| 5,185,134 | 2/1993 | Gullett | 110/345 |

*Primary Examiner*—John T. Kwon
*Attorney, Agent, or Firm*—Harrison & Egbert

[57] ABSTRACT

A process for the recycling of organic waste including the steps of passing a waste into a first sealed container, introducing an inert gas into the interior of the first sealed container so as to displace oxygen from within the container, heating the interior of the first sealed container to a temperature of between 1,000° and 2,700° F. so as to form a heated gas within the sealed container, filtering the heated gas so as to remove sulfur and chlorine byproducts of the heated gas, and transmitting the filtered gas to a storage vessel. The step of passing includes the steps of storing a liquid waste within a waste container and injecting carbon dioxide into the waste container so as to propel the liquid waste to the sealed container. The inert gas is passed continuously into the sealed container during the step of heating. The inert gas can be argon. The filter can include a sodium hydroxide filter and a chlorine-removing filter. A water filter receives the heated gas so as to remove carbon components of the heated gas.

20 Claims, 1 Drawing Sheet

PROCESS FOR THE RECYCLING OF ORGANIC WASTES

TECHNICAL FIELD

The present invention relates to apparatus and methods for the recycling of waste. More particularly, the present invention relates to those apparatus and methods in which the waste product is heated to a high temperature that such the waste is converted. Additionally, the present invention relates to apparatus and methods for waste recycling that gasify waste in an oxygen-free environment.

BACKGROUND ART

Garbage and waste are produced in communities in great quantities. This garbage and waste must be disposed of in a variety of ways. The disposal of various kinds of garbage and waste in large quantities in cities is one of the important new administrative problems facing city government. Typical methods for the disposal of garbage include discharging garbage into the sea for reclamation and burying garbage underground. However, there are great problems, such as pollution of sea water and difficulty in getting land, associated with these methods. The general trend at present is directed toward the disposal of garbage by complete incineration. However, and unfortunately, the prevailing technique for the disposal of garbage is by incineration, a method used which burns garbage on fire grates with large quantities of air supplied, thus creating a number of associated problems.

It has been found that the use of large quantities of air produces large quantities of exhaust gases, thereby creating and exacerbating air pollution. Since the combustion temperature of garbage is relatively low, the residue of burnt garbage cannot be made completely harmless. A great deal of environmental pollution is caused by such effluents from this incineration process. Since the combustion of garbage on fire grates is unstable, the efficiency of heat recovery is low and it is difficult to effectively use the heat generated by the combustion and garbage. Additionally, vast space is occupied by the fire grates. This requires a large area for the combustion site. Furthermore, there is a difficulty in getting the sites for the construction of large incinerating plants because of the environmental problems associated therewith.

Recently, disposal methods have been proposed which attempt to solve some of the problems associated with thermal decomposition. Essentially, the garbage is introduced into an incinerator with the heat necessary for thermal decomposition so as to produce a generated slag and gas. There are two processes that are available—a process which uses external heat as an intense heat source necessary for thermal decomposition and a process which utilizes heat generated by the partial oxidation of the garbage with air or oxygen supplied. In the former process, since an external heat is used, the problem lies in economy. In the latter process, since combustion gas gets mixed with generated gas, the calorific value of generated gas is decreased, disadvantageously making the usefulness of the generated gas inferior to that of the former process.

Another problem facing city governments is the disposal of toxic or hazardous materials, such as polychlorinated biphenyls (PCB's). These are toxic and hazardous compounds whose use is being withdrawn or prohibited because of the irreversible harm to the health and the environment. These materials must be managed and disposed of effectively. In addition to polychlorinated biphenyls, there are also organophosphorous, organonitrogen, and organometallic compounds, as well as other materials, that exist in massive quantities and demand effective means of disposal. The majority of the toxic compounds are in a complex matrix format often combining organic and inorganic compounds or fractions, and in these cases, little or no disposal technology is available.

Various methods have been used for disposing of these toxic wastes, including thermal destruction, chemical detoxification, long-term encapsulation and specific landfill methods. With the exception of high temperature incineration, little success has been demonstrated for the safe disposal of highly toxic or extremely persistent waste, such as PCB's. The methods that have been tried have either not been able to handle anything but homogenous waste feed streams or they have only been able to handle relatively low concentrations of toxic compounds in the waste materials. Further, very few of the disposal methods tried to date have been able to develop to operate on a commercial scale.

Of the many methods tried for the disposal of toxic or hazardous wastes, thermal destruction has been the most promising. However, the toxic waste materials are usually very stable organic molecules, and they require long dwell times at high temperatures to effect thermal destruction. Some combustion or incineration systems can achieve the necessary conditions, but the facilities required are very large scale, and often the products of the combustion process present as much of a disposal problem as the original toxic wastes.

In the past, attempts have been made to use electric plasma arcs to destroy toxic wastes. An electric plasma arc system, being essentially pyrolyric, overcomes many of the deficiencies of an incineration or combustion process. The volume of gaseous products produced is much less. As a result, the equipment is substantially smaller in scale. Laboratory demonstrations have shown that a plasma arc is capable of atomizing and ionizing toxic organic compounds, and these atoms and ions usually recombine into simple products. While residual toxic materials are formed, these can be captured, so that no significant amount of toxic material is released to the environment.

Unfortunately, such pyrolytic destruction of waste materials is not suitable for a commercially viable system. Often, the gaseous products that are released into the environment can contribute to various forms of air pollution. In addition, the release of such gases causes concern among the various regulatory authorities in control of the destruction of such toxic materials. Furthermore, and importantly, such plasma arc, pyrolyric methods of waste destruction are extremely costly processes. The cost of the power needed to operate lasers, plasma arcs, or various other methods, cannot be justified on a large scale garbage disposal basis. Furthermore, the by-products of the combustion process are not acquired for later sale or cost offset.

Various United States patents have attempted to address the issue of waste disposal by high temperature incineration process. U.S. Pat. No. 4,665,841, issued on May 19, 1987, describes a municipal trash destruction system in which hydraulic systems move the rubbish, garbage, and other municipal trash into a processor. The processor includes a trash processing zone, a fractionating system, a combustion zone, a heating exchange zone, a waste heat recovery system, and a precipitator for cleaning the emissions prior to release into the atmosphere. U.S. Pat. No. 4,644,877, issued on Feb. 24, 1987, describes the pyrolyric destruction of toxic and hazardous waste materials. The waste materials are fed into a plasma arc burner where they are atomized and ionized. These materials are then discharged into a reaction chamber to be cooled and recombined into product gas and particulate matter. The product gas is then extracted from the recombining products using a scrubber. The product gas may then be burned and utilized as a fuel. U.S. Pat. No. 4,695,448, issued on Sep. 22, 1987, describes the dissociating of toxic compounds by an electric arc (e.g. 12,000° F.) in an airtight chamber charged with oxygen. U.S. Pat. No. 4,759,300, issued on Jul. 26, 1988, shows a method and apparatus for the pyrolysis of waste products. In this invention, the waste materials to be pyrolyzed are efficiently dehydrated prior to introduction into the pyrolysis retort using microwaves generated by a large microwave generator. After the waste material is dried, the initial ignition of the material is accomplished by using a high intensity laser beam. Laser ignition is continued until sufficient methane and other volatile gases are produced for burning in a burner unit to sustain the pyrolysis reaction. U.S. Pat. No. 4,667,609, issued on May 26, 1987, describes the destruction of soil contaminated with hydrocarbons by passing the material through a sealed, negatively pressurized, high temperature furnace. The temperature in one zone of this process is maintained at 2,900° F. so as to effectively destroy the contaminating hydrocarbons. U.S. Pat. No. 3,575,119 shows an apparatus for disintegrating and incinerating a concentrated slurry of solid organic material. Material passes through an arcuate tunnel having a plurality of arc electrodes spaced therealong. These electrodes cause the temperature to abruptly raise from about 2,000° F. to about 15,000° F. so as to dissolve the bonds between the carbon and the other atoms.

The present invention relates closely to the process identified in U.S. Pat. No. 4,934,286, issued on Jun. 19, 1990 to the present inventor. This process included the introduction of the waste into a heated container. The container is capable of generating temperatures of greater than 2,700° F. so as to convert waste, both organic and inorganic, into a gas. Although the system is very productive in the destruction of waste, there are certain aspects of this process which have been improved upon by the present inventor. In particular, although temperatures of greater than 2,700° F. are effective, but sometimes the cost of generating such heat is not warranted for the destruction of certain organic wastes. Lower temperatures can achieve a similar solution. Secondly, no matter how effectively the inert gas was introduced into the reactor, an oxygen component would continually develop from the burning of the waste. As a result, although oxygen was initially removed from the process, certain oxygen components would develop as a result of the reaction process. Furthermore, oxygen could possibly be introduced into the system through the process of transmitting the waste into the interior of the reaction vessel. As a result, a better technique was required for the transmission of such wastes to the reactor. U.S. Pat. No. 4,934,286 is incorporated herein by reference hereto.

It is an object of the present invention to provide a waste recycling system that cleanly burns the waste material.

It is another object of the present invention to provide a waste recycling system that is cost-effective.

It is a further object of the present invention to provide a waste recycling system in which the waste is burned in an oxygen-free environment.

It is still another object of the present invention to provide a waste recycling system which minimizes the generation of oxygen byproducts during the waste disposal process.

It is still another object of the present invention to provide a waste recycling system in which the waste can be reacted with a water filter and a sodium hydroxide filter so as to remove the harmful byproducts of the combustion process.

These and other objects and advantages of the present invention will become apparent from a reading of the attached specification and appended claims.

SUMMARY OF THE INVENTION

The present invention is a process for the recycling of organic waste that comprises the steps of: (1) passing a waste into a first sealed container; (2) introducing an inert gas into the interior of the first sealed container so as to displace oxygen from within the first sealed container; (3) heating the container of the first sealed container to a temperature of between 1,000° and 2,700° F. so as to form a heated gas within sealed container; (4) filtering the heated gas so as to remove sulfur and chlorine byproducts of the heated gas; and (5) transmitting the filtered gas into a storage vessel.

The step of passing includes the steps of storing a liquid waste within a waste container, and injecting carbon dioxide into the waste container so as to propel the liquid waste to the first sealed container. In particular, the waste container is pressurized with carbon dioxide to a pressure of up to 100 p.s.i., and a valve is opened between the waste container and the first sealed container.

In the present invention, the inert gas is argon. This argon is continuously introduced into the sealed container during the step of heating.

In the present invention, a second sealed container can be provided which has a temperature similar to that of the first sealed container. Heated gases are passed from the first sealed container to the second sealed container so as to obtain a second combustion of the materials within the sealed container.

In the present invention, the step of filtering includes the steps of filtering the heated gas from the second sealed container so as to remove sulfur and chlorine byproducts. The heated gas is passed through a water filter so as to remove a carbon component from the heated gas. A liquid is drained from the water filter when the level of water within the water filter exceeds a predetermined limit. The carbon component of the gas is converted into carbonic acid. This carbonic acid is removed from the water filter. The heated gas is passed through a sodium hydroxide filter so as to remove a sulfur component from the heated gas. This heated gas is passed through a chlorine-removing filter so as to remove chlorine from the heated gas. The chlorine-removing filter can include a chemical such as potassium permanganate or hydrogen peroxide.

The storage vessel is at least partially filled with a liquid. The filtered gas is introduced to the storage vessel such that the liquid in the storage vessel is displaced. This displaced liquid flows from the storage vessel. Gaseous components of the filtered gas can, if necessary, be flared.

DETAILED DESCRIPTION OF THE INVENTION

Figure 1:
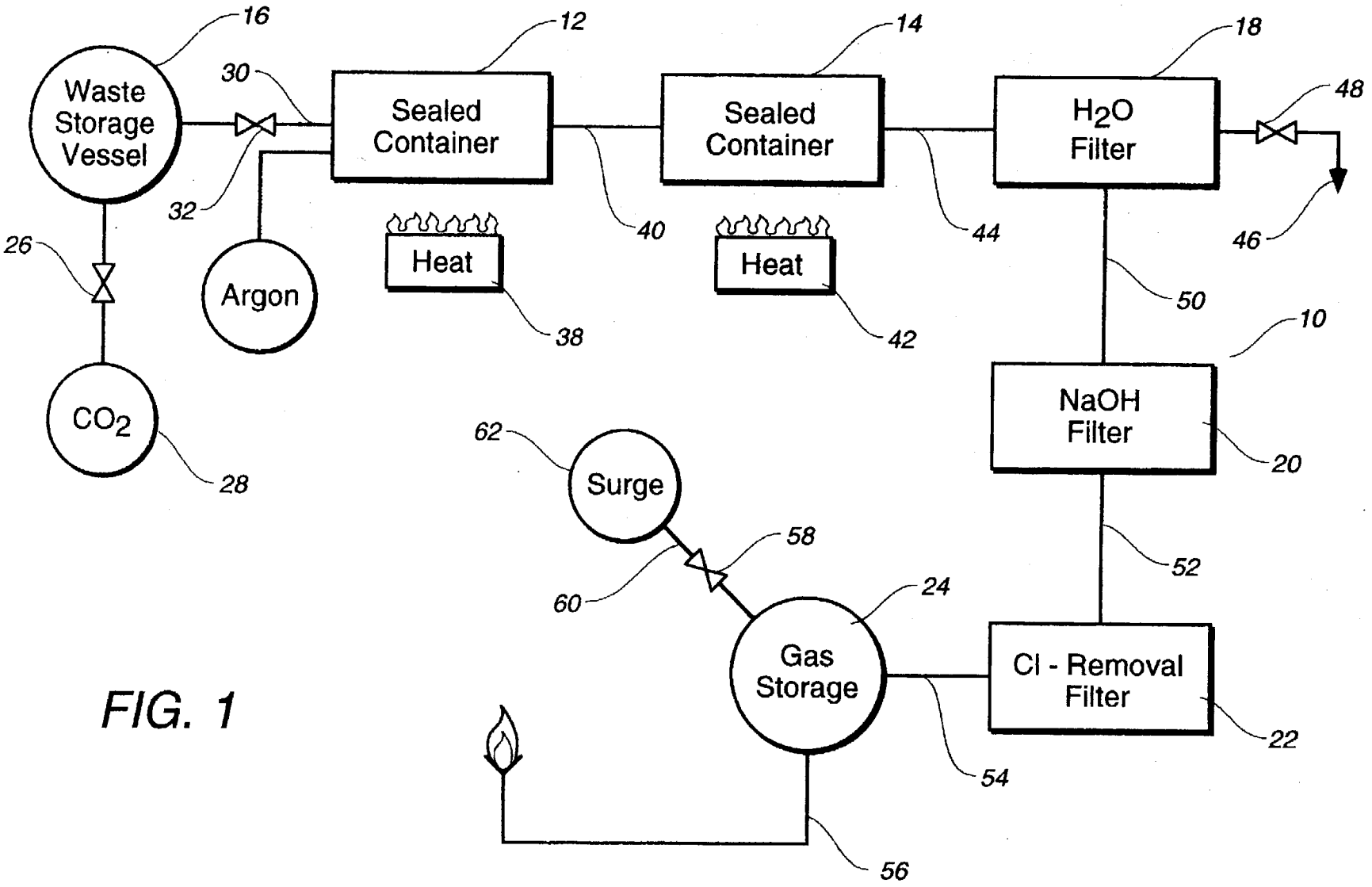
FIG. 1 is a schematic representation of the process of the present invention.

Referring to FIG. 1, there is shown at 10 the waste recycling system in accordance with the preferred embodiment of the present invention. Specifically, the waste recycling system 10 includes a first sealed container 12, a second sealed container 14, a waste storage vessel 16, a water filter 18, a sodium hydroxide filter 20, a chlorine-removing filter 22, and a gas storage tank 24.

The sealed container 12 is the apparatus that receives the waste. Sealed container 12 acts as the receptacle for the waste and for the gasification of such waste. As described herein, the container 12 is a "sealed container" since the container 12 is part of a closed system.

The sealed container 12 receives waste into its interior from the waste storage vessel 16. The waste that is transmitted from the waste storage vessel 16 to the sealed container 12 is a liquid organic waste. Importantly, the waste storage vessel 16 is connected by line 26 to a supply of carbon dioxide 28. The waste storage vessel 16 is connected to the first sealed container 12 through a line 30. Valve 32 is provided on line 30. Initially, when it is desired to load the first sealed container 12 with the liquid waste from the waste storage vessel 16, the valve 26 is opened so as to allow carbon dioxide to enter the vessel 16. In essence, the carbon dioxide is used to "pressurize" the interior of the waste storage vessel 16. Ideally, in the preferred embodiment of the present invention, the interior of the waste storage vessel 16 should be pressurized with the carbon dioxide up to a pressure of up to 100 p.s.i. By introducing the carbon dioxide into the waste storage vessel 16, oxygen is displaced from the interior of the storage vessel 16. The carbon dioxide can be effectively filtered and removed from the gas products of the process 10 at a later stage. When the waste storage vessel 16 is sufficiently pressurized, valve 32 can be opened so as to allow the liquid waste from the waste storage vessel 16 to be propelled through line 30 into the interior of the first sealed container 12. The carbon dioxide 28 serves as a propellant for the movement of the liquid waste.

The first sealed container 12 is connected by line 34 to a supply of an inert gas 36. In the preferred embodiment of the present invention, the inert gas is argon. The line 34 communicates with the interior of the sealed container 12 so as to allow the gas from the inert gas supply 36 to be delivered into the interior of the sealed container 12. The inert gas is used so as to displace and expel any oxygen that removes within the sealed container 12.

Heat is applied to the sealed container 12 by a heater 38. Heater 38 generates sufficient heat so as to cause the interior of the sealed container 12 to achieve a temperature of between 1,000° and 2,700°. The heater 38 can be an induction heater which is positioned below the sealed container 12. The only important requirement for the heater 38 is that it generate a suitable temperature in an oxygen-free environment to gasify any waste delivered into the interior of the sealed container 12. Thermocouples and oxygen analyzers can be connected to the sealed container 12 so as to monitor the conditions on the interior of the sealed container 12.

Line 40 is connected to sealed container 12 so as to deliver the gaseous products of the sealed container 12 to a second sealed container 14. The second sealed container 14 is an optional element of the configuration of the present invention. It has been found that the use of a second sealed container unexpectedly provides for further decomposition of wastes passed from the first sealed container 12. The reasons for such further decomposition are not entirely known, but may result from the inability of the heat flux on the interior of the first sealed container 12 to reach all of the waste on the interior of the container 12. The second sealed container 14 also is heated with a heater 42. Generally, the second sealed container 14 will be heated to a temperature similar to that of the first sealed container 12. The configuration of sealed containers 12 and 14 provides for the effective decomposition of the waste. Additionally, it has been found that the use of two containers may reduce the overall capital costs associated with the construction of the system.

Line 44 communicates with the interior of the second sealed container 14 so as cause the gaseous composition produced by the dissociation of the waste materials to pass from the container 14. Line 44 extends from the second sealed container 14 to a water filter 18. The water filter 18 will contain water and sand. Any heated gases from the sealed container 14 will percolate through the sand and the water so as to allow for the removal of carbon components from the heated gas. An aerator can be included within the water filter 18 so as to cause an even distribution of the gaseous composition through the water filter 18. The use of sand can further facilitate the even distribution of the heated gas. Stainless steel screens can be incorporated within the water filter 18 so as to trap and remove sulfur, carbon black, and other particulate matter that may reside within the heated gas passing through the water filter 18. The water filter 18 causes the carbon black, the carbon dioxide, and the carbon monoxide of the gaseous composition to mix with the water so as to become carbonic acid and carbon black in solution. It also serves to cool the gaseous composition passing therethrough.

Experimentation with the present invention has found that the interaction of the gaseous components with the water in the water filter 18 will actually cause the production of a certain amount of water from the gaseous composition. As a result, it is necessary to drain excess water through line 46 and through valve 48. Valve 48 can be opened whenever the water within the interior of the water filter 18 exceeds a predetermined level.

The water-filtered gaseous composition will then pass from the water filter 18 through line 50 to the sodium hydroxide filter 20 and, in turn, to the chlorine-removing filter 22. The gaseous composition will percolate through the sodium hydroxide filter 20. Stainless steel screens can be positioned within the sodium hydroxide filter 20 so as to remove sulfur and other particulate matter from the gaseous composition. As the gaseous composition passes through the sodium hydroxide solution within the sodium hydroxide filter 20, the sulfur is removed from the gas. Additionally, salts, in solid form, can be formed by the interaction of the gaseous composition with the sodium hydroxide in the sodium hydroxide filter 20.

After the gaseous composition has reacted with the sodium hydroxide in filter 20, the gaseous composition will pass through line 52 to a chlorine-removing filter 22. The chlorine-removing filter 22 can contain either potassium permanganate or hydrogen peroxide. The gaseous composition will react with such chemicals so as to cause the chlorine in the gaseous composition to be converted into a salt. This salt can then be removed, by conventional techniques, from the chlorine-removing filter 22.

The gaseous composition will pass from the chlorine-removing filter 22 through line 54 to a gas storage vessel 24. The storage vessel will receive the gaseous composition, as filtered, from the pipe 54. This storage vessel 24 includes a flare 56 for the incinerating of certain gaseous components.

Importantly, the gas storage vessel 24 is filled, at least partially, with a liquid. As the filtered gaseous composition is introduced into the vessel 24, the liquid is effectively displaced. The liquid on the interior of the vessel 24 will flow through valve 58 and line 60 to a surge tank 62. Surge tank 62 receives the overflow of the water from the gas storage vessel 24. By filling the gas storage vessel 24 with a liquid, such as water, unwanted gaseous components, such as oxygen and nitrogen, are minimized in the resulting gas composition.

The storage vessel 24 will include the gaseous composition and its many compounds. These gases can be removed from the storage vessel 24 for use and sale elsewhere. The various components of the gas within the gas storage vessel 24 can be separated so as to produce a sellable commodity. The ability to produce and sell the gases resulting from the process of the present invention allows the process to be economical. Ultimately, the value of the gases produced from the initial waste could offset the operating cost of the system.

In the present invention, since the waste is being gasified in an oxygen-free environment, the oxygen is not available to cause pollution. By the process of the present invention, carbon dioxide, carbon monoxide, chlorine, and sulfur dioxides are not released. Inert gases will not combine with disassociated molecules so as to form pollutants. Additionally, since the inert gas is argon, nitrates and nitrites are not formed by the process of the present invention. Through the use of the continuous addition of argon to the sealed container 12, any oxygen produced as a result of the burning of the waste is diluted. As a result, any oxygen within the system 10 exists in very low concentration.

The present invention achieves a pollution-free destruction of waste. Since the destruction of the waste occurs in an oxygen-free environment, there is no pollution to be released into the atmosphere. Furthermore, the product of valuable gases from the process of the present invention allows such gases to be sold separate and apart from the destruction process itself. The value of such gases, at least, will economically offset the cost of the operation of the waste destruction system.

The foregoing disclosure and description of the invention is illustrative and explanatory thereof. Various changes in the method steps may be made within the scope of the appended claims without departing from the true spirit of the invention. The present invention should only be limited by the following claims and their legal equivalents.

I claim:

1. A process for the recycling of organic waste comprising the steps of:

passing a waste into a first sealed container;

introducing an inert gas into the interior of said first sealed container so as to displace oxygen from within said first sealed container;

heating the container of said first sealed container to a temperature of between 1,000° and 2,700° F. so as to form a heated gas within said first sealed container;

filtering the heated gas so as to remove sulfur and chlorine byproducts of the heated gas; and transmitting the filtered gas into a storage vessel.

2. The process of claim 1, said step of passing comprising the steps of:

storing a liquid waste within a waste container; and injecting carbon dioxide into the waste container so as to propel said liquid waste to said first sealed container.

3. The process of claim 2, said step of injecting comprising the steps of:

pressurizing said waste container with said carbon dioxide to a pressure of up to 100 p.s.i.; and opening a valve between said waste container and said first sealed container.

4. The process of claim 1, said inert gas being argon.

5. The process of claim 1, said step of introducing comprising:

continuously passing argon into said sealed container during said step of heating.

6. The process of claim 1, said step of heating further comprising the steps of:

heating the interior of a second sealed container to a temperature similar to that of the first sealed container; and passing the gas from said first sealed container to said second sealed container.

7. The process of claim 6, said step of filtering comprising the step of:

filtering the heated gas from said second sealed container so as to remove sulfur and chlorine byproducts.

8. The process of claim 1, said step of filtering comprising the step of:

passing the heated gas to a water filter so as to remove a carbon component from said heated gas.

9. The process of claim 8, said step of filtering further comprising the step of:

draining a liquid from said water filter when a level of water exceeds a predetermined limit within said water filter.

10. The process of claim 8, said carbon component being carbon black and carbon dioxide, said step of filtering comprising:

converting said carbon component into carbonic acid; and removing the carbonic acid from the water filter.

11. The process of claim 1, said step of filtering comprising the step of:

passing the heated gas through a sodium hydroxide filter so as to remove a sulfur component from the heated gas.

12. The process of claim 1, said step of filtering further comprising the step of:

passing the heated gas through a chlorine-removing filter, said chlorine-removing filter containing a chemical selected from the group consisting of: potassium permanganate and hydrogen peroxide.

13. The process of claim 11, said step of filtering further comprising the step of:

passing the filtered gas from said sodium hydroxide filter to a chlorine-removing filter, said chlorine-removing filter containing a chemical selected from the group consisting of: potassium permanganate and hydrogen peroxide.

14. The process of claim 1, said storage vessel being at least partially filled with a liquid, said step of transmitting comprising the step of:

introducing the filtered gas into said storage vessel such that said liquid is displaced, the displaced liquid flowing from said storage vessel as said filtered gas is introduced into said storage vessel.

15. The process of claim 1, further comprising the step of:

flaring a gaseous component of the filtered gas.

16. The process of claim 1, said interior of said first sealed container having an internal pressure of approximately 40 p.s.i.

17. A process for the recycling of organic waste comprising the steps of:

passing a waste into a first sealed container;

introducing an inert gas into the interior of said sealed container so as to displace oxygen from within said first sealed container;

heating the interior of said first sealed container to a temperature of between 1,000° and 2,700° F. so as to form a heated gas within said first sealed container, said inert gas being continuously introduced into said first sealed container during said step of heating;

filtering the heated gas so as to remove undesirable byproducts of the heated gas; and transmitting the filtered gas into a storage vessel.

18. The process of claim 17, said step of passing comprising the steps of:

storing a liquid waste within a waste container; and injecting carbon dioxide into the waste container so as to propel said liquid waste to said first sealed container.

19. The process of claim 18, said step of injecting comprising the steps of:

pressurizing said waste container with said carbon dioxide to a pressure of up to 100 p.s.i.; and opening a valve between said waste container and said first sealed container.

20. A process for the recycling of organic waste comprising the steps of:

storing a liquid waste within a waste container;

injecting carbon dioxide into the waste container so as to propel said liquid waste toward a first sealed container;

introducing an inert gas into an interior of said first sealed container so as to displace oxygen from within said first sealed container;

heating the interior of said first sealed container to a temperature of between 1,000° and 2,700° F. so as to form a heated gas within said sealed container;

filtering the heated gas so as to remove unwanted byproducts of the heated gas; and transmitting the filtered gas to a storage vessel.

* * * * *